US005195672A

United States Patent [19]

Souverain

[11] Patent Number: 5,195,672

[45] Date of Patent: Mar. 23, 1993

[54] TAG STAPLER

[75] Inventor: Michel Souverain, Montreal, Canada

[73] Assignees: D.F.I. Souverain Inc., Canada; Potomac Supply Corp., Kinsale, Va.

[21] Appl. No.: 728,266

[22] Filed: Jul. 11, 1991

[30] Foreign Application Priority Data

Jun. 27, 1991 [CA] Canada ..... 2045840

[51] Int. Cl.[5] ..... B27F 7/17

[52] U.S. Cl. ..... 227/21; 227/39; 227/47; 227/100

[58] Field of Search ..... 227/21, 29, 39, 44, 227/46, 47, 82, 99, 100; 83/423

[56] References Cited

U.S. PATENT DOCUMENTS

| | | | |
|---|---|---|---|
| 619,773 | 2/1899 | Metcalf . | |
| 2,449,188 | 9/1948 | Weller . | |
| 2,661,032 | 12/1953 | Monroe | 227/82 |
| 2,927,323 | 3/1960 | Ruskin | 227/29 X |
| 2,996,720 | 8/1961 | Mackechnie . | |
| 3,084,344 | 4/1963 | Schmidt | 227/21 X |
| 3,456,537 | 7/1969 | Quinn | 83/423 X |
| 3,991,926 | 11/1976 | Marks | 227/21 |
| 5,014,896 | 5/1991 | Reitmeier et al. | 227/150 X |

*Primary Examiner*—Frank T. Yost
*Assistant Examiner*—Rinaldi Rada
*Attorney, Agent, or Firm*—Larson and Taylor

[57] ABSTRACT

An apparatus for stapling tags onto timber, comprising a tag feeder supplying tags in strip form to a tag applicator station which cuts the tag strip in individual tags and fastens the tags onto timber with wire staples. The tag applicator station includes a cutter transversely severing the tag strip against an anvil plate, and a leaf spring mounted on the cutter for engaging the tag which is being cut and retaining same against an abutment plate and a stapler gun applying a staple wire to a timber piece in registration with the tag applicator station through the tag held between the leaf spring and the abutment plate.

10 Claims, 5 Drawing Sheets

TAG STAPLER

FIELD OF THE INVENTION

The present invention relates to equipment for applying indicia to articles and more particularly to an apparatus for fastening automatically tags onto timber with wire staples.

BACKGROUND OF THE INVENTION

To prevent timber from rotting and degrading under harsh environmental conditions, it is common practice to pressure treat the wood with chemicals which have the ability to considerably slow down its natural decomposition. Such pressure treated timber is normally guaranteed by the manufacturer for a minimal useful life and it is common practice to express the warranty conditions onto a label or a tag fastened on each timber piece produced by the mill. Presently, tagging the timber is accomplished manually by using a hand operated stapler gun for fastening individual tags to timber pieces with wire staples. Accordingly, this seamingly simple operation is time consuming, which constitutes a disadvantage.

OBJECT AND STATEMENT OF THE INVENTION

It is an object of the present invention to provide an apparatus for dispensing and automatically fastening tags onto timber.

The present invention features an apparatus for stapling tags onto timber, comprising:

tag feeder, including:

a) a magazine for holding a continuous strip comprised of individual tags attached endwise to one another;

b) a guide system establishing a predetermined path for advancing the continuous strip away from the magazine;

c) a strip drive engaging the strip for advancing same along said path;

tag applicator station located at an end of said path, said tag applicator station cutting the tag strip in individual tags and fastening the tags onto timber with wire staples, the tag applicator station including:

a) an anvil member;

b) a cutter movable with respect to the anvil member between operative and inoperative positions, in the operative position the cutter transversely severing the strip against the anvil member to separate a tag from the tag strip;

c) a temporary tag holder adjacent the anvil member, said temporary tag holder being responsive to movement of the cutter toward the operative position for engaging and retaining the tag separated from the tag strip in a predetermined position;

d) a stapler gun adjacent the temporary tag holder for applying a staple wire to a timber piece in registration with the tag applicator station through the tag separated from the tag strip while it is being held in the predetermined position in which it extends between the stapler gun and the timber piece;

a controller for actuating the strip drive, cutter and stapler gun in a timed relationship.

In a preferred embodiment, the temporary tag holder is a leaf spring mounted to the cutter and resiliently clamping the tag against a stationary abutment plate for holding the tag in a proper position while a wire staple is being driven in the piece of timber.

In a preferred embodiment, the tag strip is provided with registration holes arranged longitudinally thereon which are engaged by the spokes of a sprocket wheel driven by a stepper motor, rotating the sprocket wheel in uniform angular movements to advance the strip stepwise by a length corresponding to the length of a single tag.

In a variant, a bar code applicator is provided in the tag feeder for imprinting or otherwise applying information on the tag strip in bar code format.

DESCRIPTION OF A PREFERRED EMBODIMENT

Figure 1:
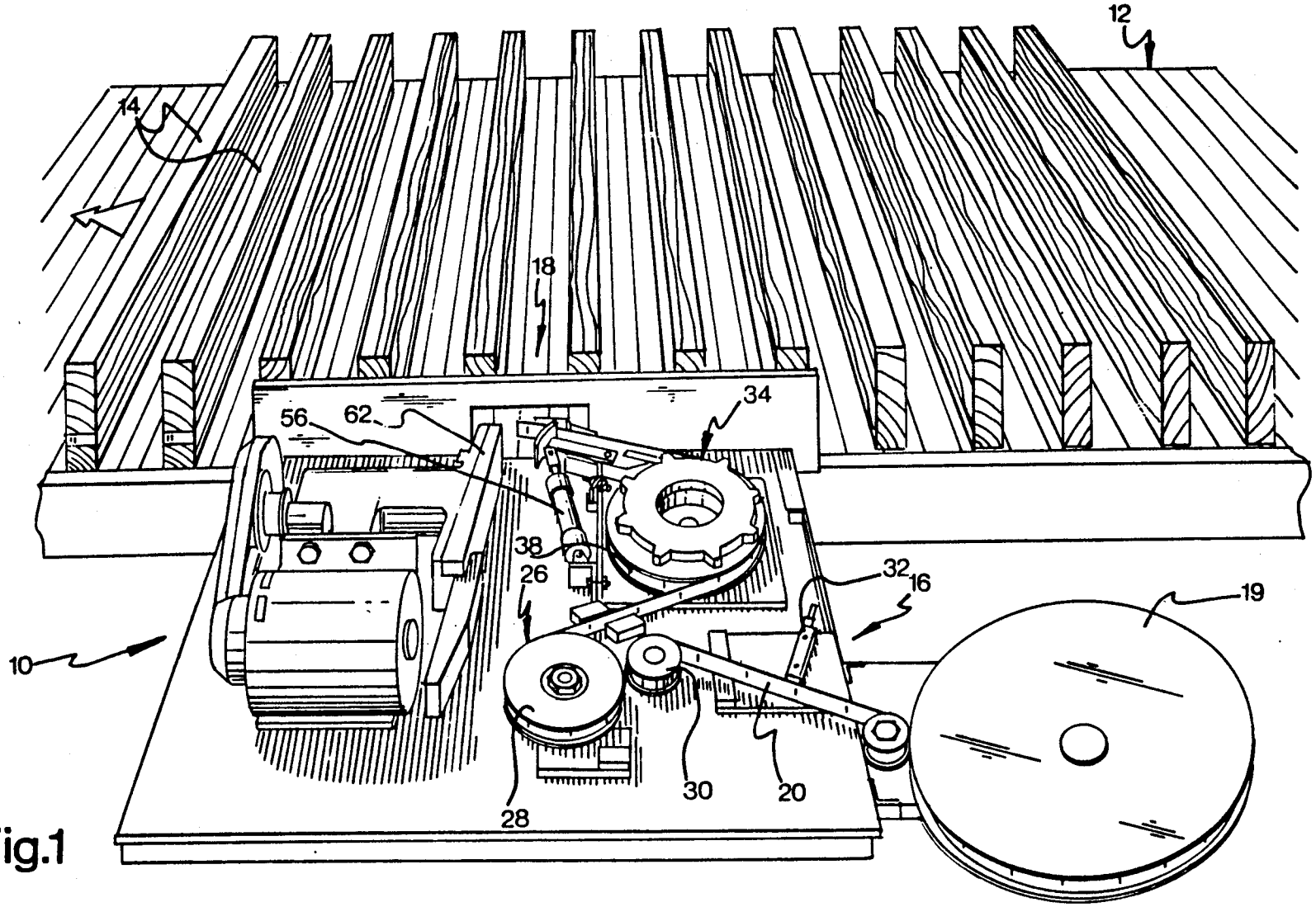
FIG. 1 is a perspective view of an apparatus for stapling tags onto pieces of timber constructed in accordance with the present invention.

FIG. 1 illustrates an apparatus designated comprehensively by the reference numeral 10 for automatically stapling tags bearing a certain information onto pieces of timber. Normally, the machine 10 is associated with a timber conveying device 12, such as a conveyor belt on which timber pieces 14 are placed, oriented transversely to the direction of movement of the conveyor belt whereby an extremity of each timber piece 14 passes in proximity to the tag applying machine 10 which dispenses and fastens a tag thereon. In a variant, the pieces of timber 14 may be held stationary and the machine 10 made moveable to apply a tag to each timber piece.

The tag applying machine 10 has two main components, namely a tag feeder 16 which supplies tags to an applicator station 18 whose function is to dispense and fasten the tags onto the pieces of timber 14 travelling on the conveyor belt.

Figure 3:
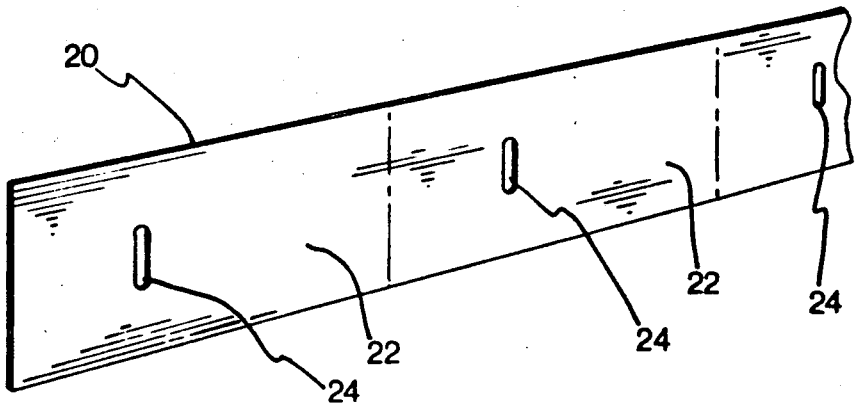
FIG. 3 is a perspective view of tags in continuous strip form for use with the apparatus shown in FIG. 1.
Figure 2:
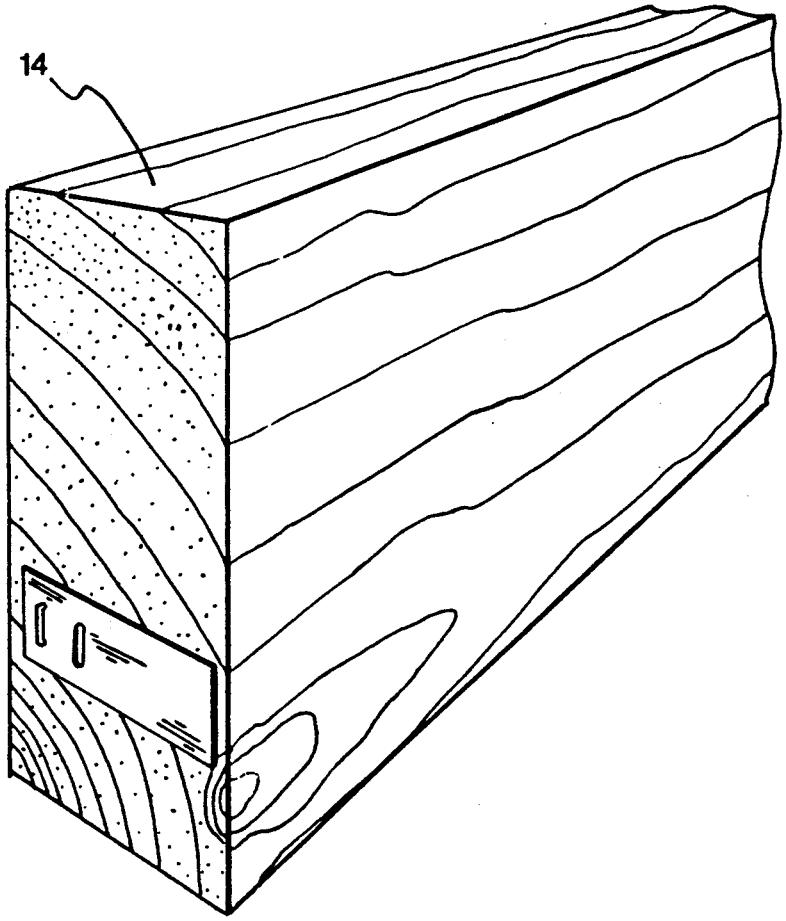
FIG. 2 is an enlarged perspective view of a piece of timber carrying a tag applied by the apparatus shown in FIG. 1.

The tag feeder 16 comprises a magazine 19, in the form of a bobbin on which is wound a tag strip 20 whose structure is best shown in FIG. 3. The tag strip 20 is made of any suitable flexible material such as plastics material, cardboard or the like and it is comprised of individual tags 22 which are attached endwise to one another. In practice, the strip 20 is made from a continuous band on which is serially imprinted the information constituting a single tag.

Registration holes 24, longitudinally oriented on the strip 20, are punched thereon, one per tag.

Referring back to FIG. 1, the strip 20 passes from the magazine 19 through a tensioner assembly 26 comprising idler pulleys 28 and 30, the pulley 30 being spring biased to take up the slack in the strip 20 and to build a certain tension therein. Between the tensioner assembly 26 and the magazine 19 is provided a strip detector 32, utilizing a photocell for sensing the presence of the strip 20 and to stop the machine 10 when the supply of the strip 20 is interrupted which may occur either when the magazine 19 is empty or when the strip breaks.

Figure 4:
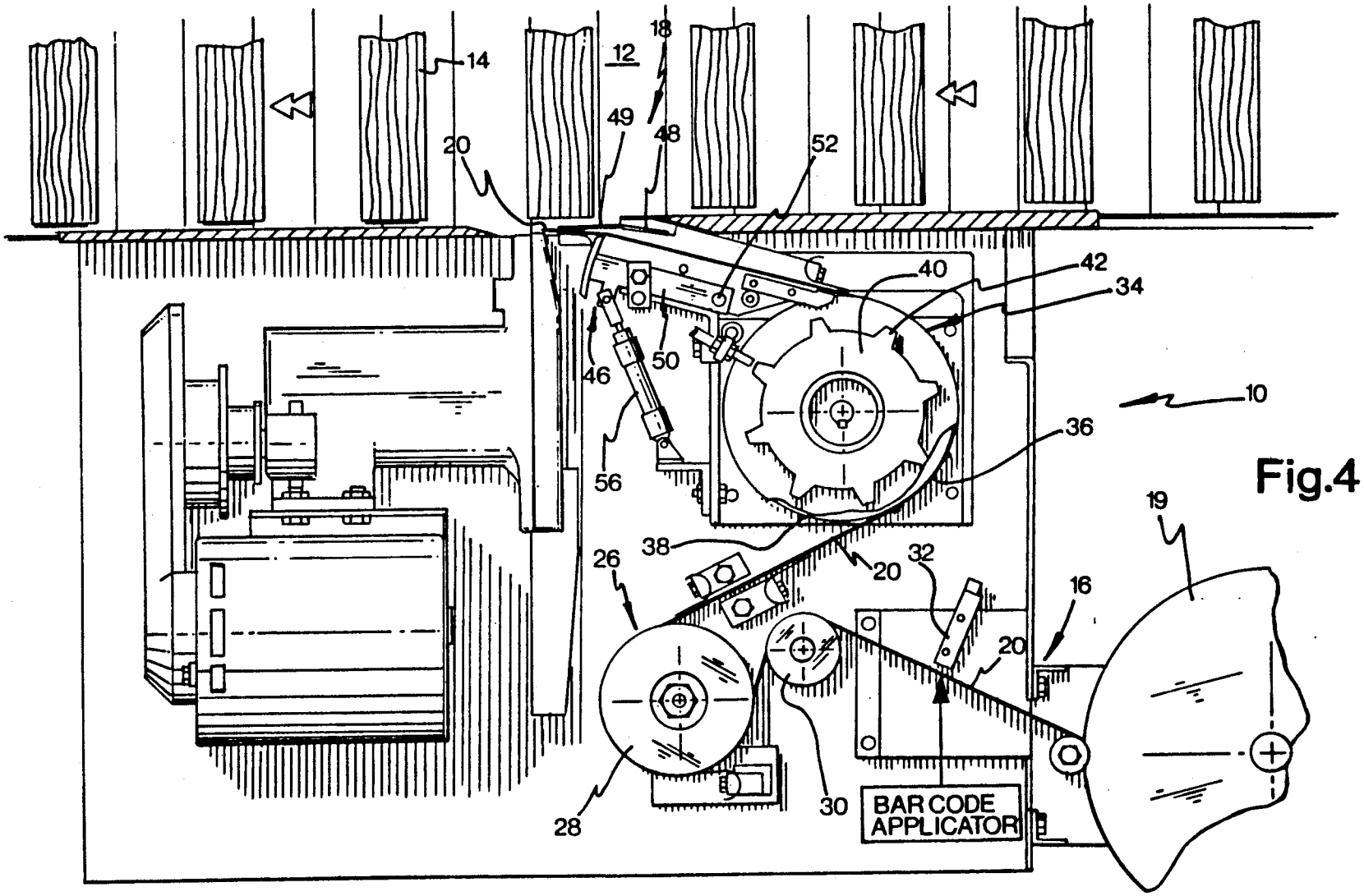
FIG. 4 is a top plan view of the apparatus shown in FIG. 1.
Figure 5:
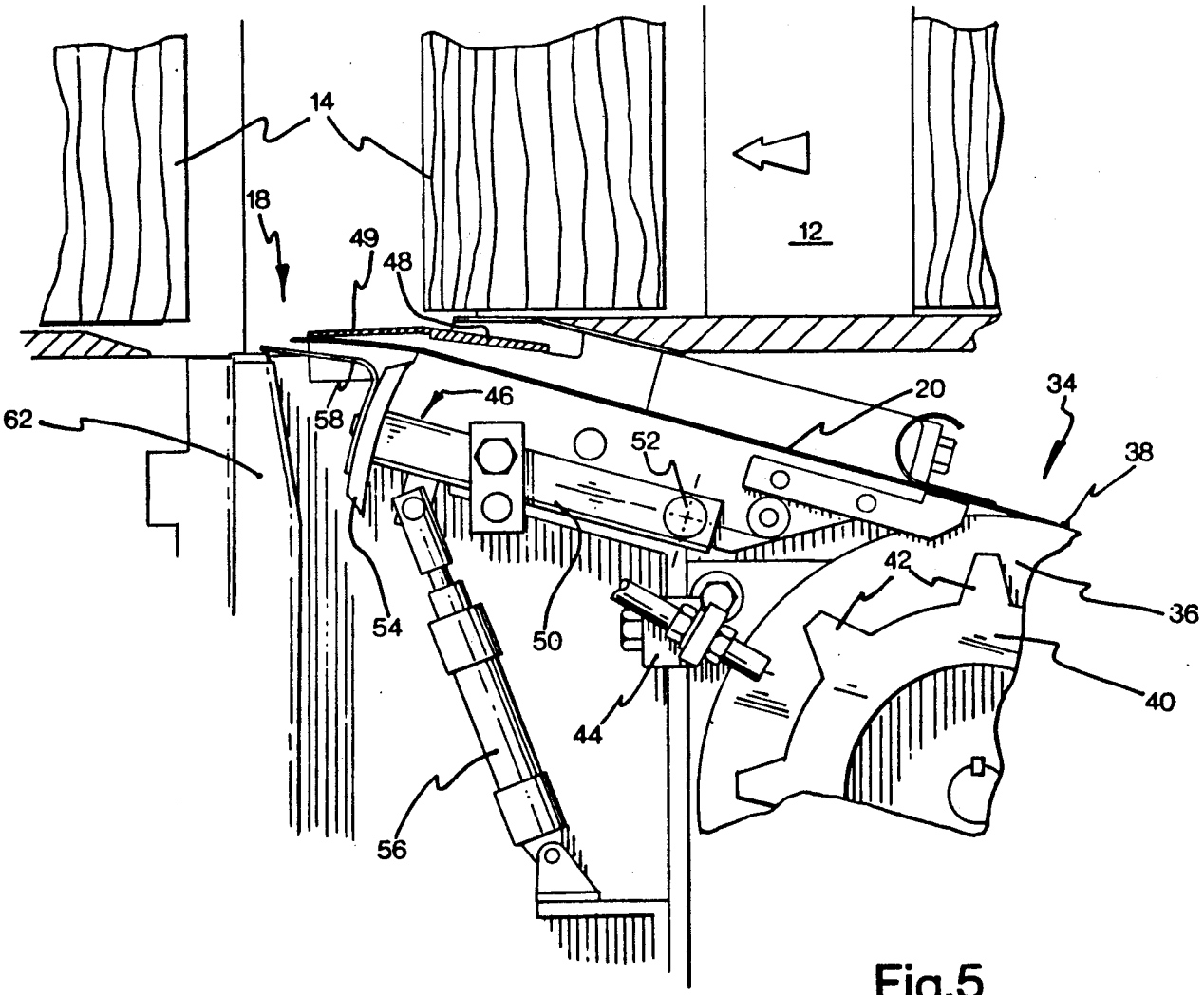
FIG. 5 is an enlarged top plan view of the tag applicator station of the apparatus shown in FIG. 1, more particularly depicting the tag strip cutter in an operative position.
Figure 6:
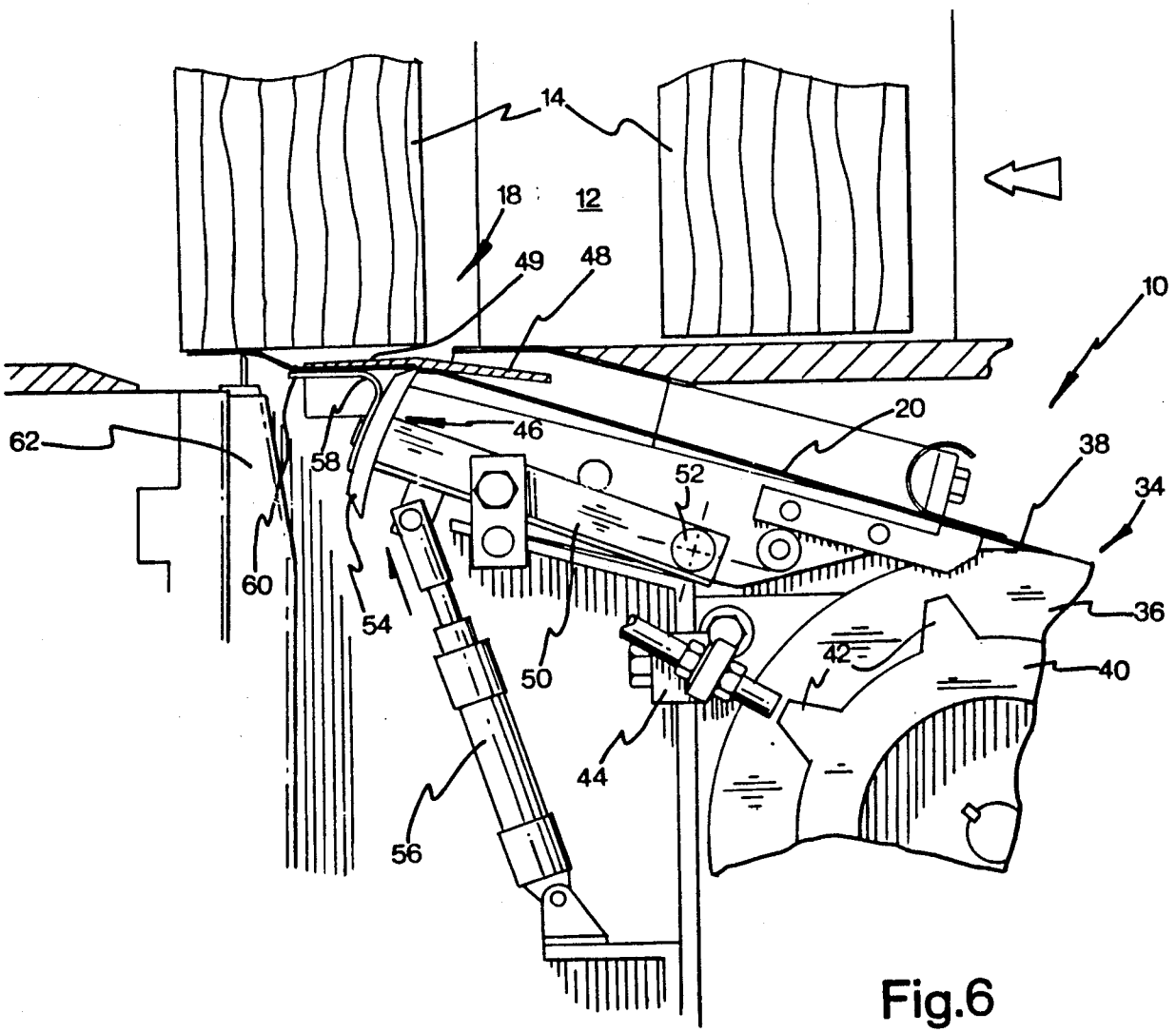
FIG. 6 is a view similar to FIG. 5 except that the cutter is shown moving toward the inoperative position.

Downstream of the tensioner assembly 26 is mounted a strip drive 34 which is illustrated in greater detail in FIGS. 4, 5 and 6. The strip drive 34 comprises a sprocket wheel 36 with spokes 38 spaced from one another by a sector length corresponding precisely to the distance between two adjacent registration holes 24 on the tag strip 20. Accordingly, when the strip 20 is in a wrapping engagement with the sprocket wheel 36, a plurality of registration holes are engaged by spokes 38, preventing the strip 20 to slip on the sprocket wheel 36.

On top of the sprocket 36 is provided a metallic star-wheel 40 provided with radially outwardly extending projections 42 corresponding in position to the spokes 38.

Adjacent the sprocket 36 is provided a magnetic pick-up 44 generating an output signal when one of the projections 42 passes in proximity thereof. The purpose of the magnetic pick up 44 is to provide an electric signal conveying information on the position of the spokes 38 relatively to a fixed point on the frame of the machine 10.

The sprocket 36 is driven by a stepper motor (not shown in the drawings) advancing the sprocket wheel in essentially uniform angular intervals corresponding to the angular spacing between adjacent spokes 38. In a variant, a servo-motor may be used which has the advantage of providing a stepped rotational movement where the length of the angular intervals can be controlled by adjusting the input signal to the servo-motor.

As best shown in FIG. 4, the tag applicator station 18 comprises a cutter assembly 46 receiving the strip 20 from the strip drive 34 and cutting the strip 20 in individual tags. The cutter assembly 46 includes a stationary anvil plate 48, a blade carrier 50 pivotally mounted about a vertical axis 52 to the frame of the machine 10 and a cutting blade 54 mounted to the blade carrier 50.

As shown in greater detail in FIG. 5, the blade carrier 50 is actuated and pivots about axis 52 in response to extension and retraction of a pneumatic piston-cylinder assembly 56.

From the anvil plate 48 projects laterally an abutment plate 49, which faces a leaf spring 58, mounted to the blade 54, having a wing 60 which projects away from the blade 54 to define a narrow angle with the abutment plate 49. The abutment plate 49 and the leaf spring 58 form a temporary tag holder used to retain a tag severed by the blade 54 in a predetermined position before the tag is being fastened to a timber piece 14.

A stapler gun 62 adjacent the wing 60 of the leaf spring 58 is provided for driving staples into a timber piece 14 facing the tag applicator station 18. The stapler gun 62 will not be described in detail because it is a commercially available item and its construction is well-known to those skilled in the art. Preferably, the stapler gun 62 is of the type operating with a continuous wire supplied from a wire bobbin. In this embodiment, a magnetic pick-up may be provided (not shown in the drawings) to sense the presence of the wire. Should the supply be depleted, the magnetic pick-up causes the machine 10 to stop. It may also be envisaged to use a stapler gun operating from a supply of preformed wire staples, although such an embodiment would require to frequently load the stapler gun with staple cartridges.

The machine 10 operates as follows. The drive system 34 advances the strip 20 by the rotation of the sprocket wheel 36. As previously mentioned, the sprocket wheel 36 is driven by a stepper motor, and turns in essentially uniform angular movements selected to provide a sector length corresponding to the length of a single tag on the strip 20. As a result, when the sprocket wheel 36 advances by a single step, the tag strip 20 is moved by a length corresponding to one tag. When the strip has been advanced to a position where its free extremity extends beyond the abutment plate 49 as shown in FIG. 5, the pneumatic piston-cylinder assembly 56 is extended causing the blade carrier 50 to pivot about the axis 52 with the result that the blade 54 engages the anvil plate 48 and cuts the strip 20 transversely at the boundary between two adjacent tags. It will be appreciated that the length of the run of the strip 20 between the sprocket wheel 36 and the precise location where the blade 54 severs the strip 20 is selected so that the cut is performed exactly at the boundary between adjacent tags.

When the cutting blade 54 advances toward the anvil plate 48 for cutting the strip 20, the projecting wing 60 of the leaf spring 58 engages the extremity of the strip 20, pressing same against the abutment plate 49. As a result, when the strip 20 is severed, the individual tag which is being cut is held in a generally parallel relationship with the extremity of the timber piece to which it is to be applied.

Subsequently, the stapler gun 62 is actuated, driving a wire staple onto a timber piece 14 facing the stapler gun, through the extremity of the tag held between the leaf spring 58 and an abutment plate 49, extending beyond the abutment plate 49.

The advancement of the conveyor 12 causes the tag fastened to the timber piece to be smoothly pulled from the temporary tag holder formed by the abutment plate 49 and the wing 60.

The cutting assembly 46 is then brought to the inoperative position by retracting the piston cylinder assembly 56 which causes the temporary tag holder to open.

The operation of the cutter assembly 46 and the stapler gun 62 are synchronized whith the drive system 34. The synchronization signal obtained by the magnetic pick up 44 provides the information indicating when the sprocket 36 has completed a step forward, whereby the precise moment when the cutter assembly 46 and the stapler gun 62 must be actuated may be precisely determined.

In general, the operation of the machine 10 is synchronized with the advancement of the timber pieces 14, so that a tag may be applied at each timber piece precisely when it passes by the tag applicator station 18. Various sensor means may be utilized to achieve this synchronization. For example, photocells or mechanical switches may be used to sense when a timber piece is to arrive to the tag applicator 18, commanding advancement of the drive system 34 and the subsequent actuation of the cutter assembly 46 and the stapler gun 62.

The machine 10 is under the control of an electric system (not shown in the drawings) receiving signals from the various signals and outputting command signals to actuate the various components of the machine 10 in a timed relationship. Hard wired logic, such as relays and other electromechanical devices, is preferred because of its simplicity. The machine 10 may also be placed under microprocessor control for sophisticated and complex applications as it will be evident to those skilled in the art.

In a variant, the machine 10 may be equipped with a bar code printer which typically would be located downstream of the magazine 19, as shown schematically in FIG. 4, to imprint or otherwise apply on each tag of the tag strip information in a bar code format. Such printers are known in the art and they do not require a specific description.

The description of this preferred embodiment should not be interpreted in any limiting manner as it may be refined and varied in various ways without departing from the spirit of the invention. The scope of the invention is defined in the annexed claims.

The embodiments of the invention in which an exclusive property or privilege is claimed are defined as follows:

1. An apparatus for stapling tags onto timber, comprising:

tag feeder, including:

a) a magazine for holding a continuous strip comprised of individual tags attached endwise to one another;

b) a guide system establishing a predetermined path for advancing the continuous strip away from said magazine;

c) a strip device engaging the strip for advancing same along said path;

a tag applicator station located at an end of said path, said tag applicator station cutting the tag strip in individual tags and fastening the tags onto timber with wire staples, said tag applicator station including:

a) an anvil member;

b) a cutter movable with respect to said anvil member between operative and inoperative positions, in said operative position said cutter transversely severing the strip against said anvil member to separate a tag from the tag strip;

c) a temporary tag holder adjacent said anvil member, said temporary tag holder comprising means responsive to movement of said cutter toward said operative position for moving at least a portion of the tag holder against the tag to engage and retain the tag separated from the tag strip in a predetermined position; and d) a stapler gun adjacent said temporary tag holder for applying a staple wire to a timber piece in registration with said tag applicator station through the tag separated from the tag strip while it is being held in said predetermined position in which it extends between said stapler gun and the timber piece.

2. An apparatus as defined in claim 1, wherein said cutter comprises a cutting blade, said temporary tag holder comprises a stationary abutment plate adjacent said anvil member and a resilient member mounted to said cutting blade for clamping the tag separated from the strip against said abutment plate when said cutter moves toward said operative position.

3. An apparatus as defined in claim 2, wherein said resilient member is a leaf spring.

4. An apparatus as defined in claim 1, further comprising a cutter drive for moving said cutter between said operative and inoperative positions.

5. An apparatus as defined in claim 4, wherein said cutter drive includes a pneumatic piston-cylinder assembly.

6. An apparatus as defined in claim 1, wherein the tag strip has registration holes disposed longitudinally thereon, said strip drive comprising a sprocket wheel engaging the registration holes of the strip for advancing same along said path when said sprocket wheel is rotating.

7. An apparatus as defined in claim 6, further comprising a stepper motor in driving relationship with said sprocket wheel for rotating same in uniform angular movements.

8. An apparatus as defined in claim 1, further comprising a bar code applicator for applying information in bar code format on each tag of the tag strip.

9. An apparatus as defined in claim 1, wherein said staple gun is a continuous wire stapler.

10. An apparatus as defined in claim 1, further comprising a conveyor for transporting pieces of timber in proximity to said tag applicator station.

* * * * *